United States Patent [19]

Nymark

[11] Patent Number: 4,712,485

[45] Date of Patent: Dec. 15, 1987

[54] RESTRICTING BRACKET FOR AUTOMATIC TRANSPORT SYSTEM

[75] Inventor: Roald P. Nymark, Simsbury, Conn.

[73] Assignee: Gerber Garment Technology, Inc., South Windsor, Conn.

[21] Appl. No.: 946,174

[22] Filed: Dec. 22, 1986

Related U.S. Application Data

[63] Continuation of Ser. No. 738,089, May 24, 1985, abandoned.

[51] Int. Cl.[4] ..... B61B 3/00

[52] U.S. Cl. ..... 104/172.4; 104/91

[58] Field of Search ..... 104/172.4, 172.3, 172.5, 104/172.1, 91

[56] References Cited

U.S. PATENT DOCUMENTS

| | | | |
|---|---|---|---|
| 2,309,587 | 1/1943 | Hassler | 104/172 C X |
| 2,973,721 | 3/1961 | Wagter | 104/172 S |
| 3,056,360 | 10/1962 | Burmeister et al. | 104/172 S X |
| 3,541,967 | 11/1970 | Birkhead | 104/91 X |
| 3,596,606 | 8/1971 | Smith, Jr. et al. | 104/172 B |
| 3,774,546 | 11/1973 | Krammer | 104/172 S |
| 3,800,709 | 4/1974 | DeGood et al. | 104/172 S |
| 3,817,187 | 6/1974 | Thompson | 104/172 C |
| 3,861,323 | 1/1975 | Turner | 104/172 S |
| 4,147,110 | 4/1979 | Knudsen | 104/172 S |
| 4,292,897 | 10/1981 | Wakabayashi | 104/172 S |
| 4,433,628 | 2/1984 | Wakabayashi | 104/172 S |

FOREIGN PATENT DOCUMENTS

| | | | |
|---|---|---|---|
| 658065 | 10/1951 | United Kingdom | 104/172 S |
| 2042448 | 9/1980 | United Kingdom | 104/172 S |

*Primary Examiner*—Randolph A. Reese
*Assistant Examiner*—John G. Pido
*Attorney, Agent, or Firm*—McCormick, Paulding & Huber

[57] ABSTRACT

In an automated transport system which includes a rail, a plurality of free traveling trolleys riding on the rail, and chain driven pushers for propelling the trolleys along the rail, a bracket is provided on the chain for each pusher which allows a trolley located far in advance of the pusher to move into engagement with the pusher and thereafter limits the distance it can move ahead of the pusher, as for example when the trolley rides on a downwardly sloping portion of the rail. The brackets are made of plastic and are releasably connectable with the chain, with a snap fit action, so that they can be easily added to or removed from the chain as required to adapt the chain to a given application.

2 Claims, 10 Drawing Figures

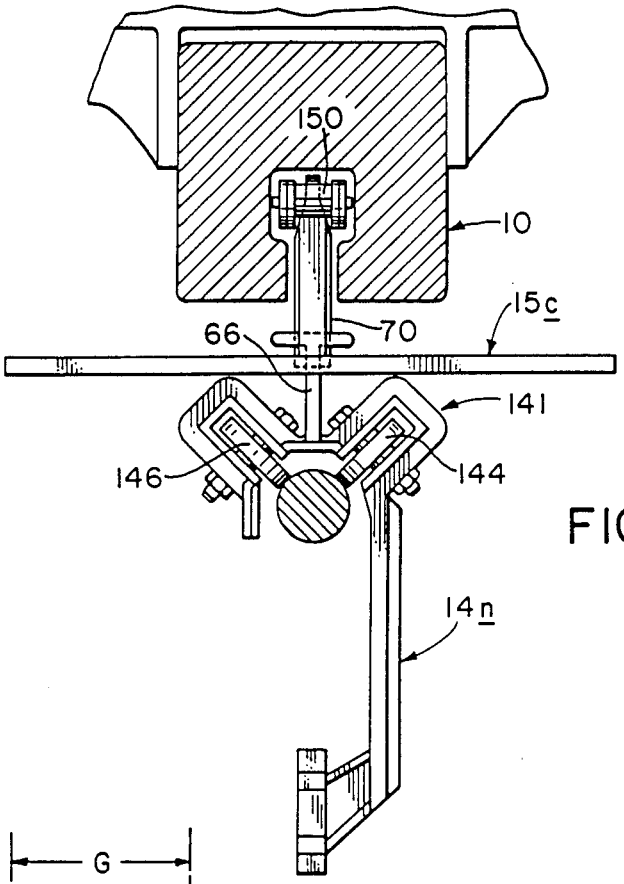
FIG. 4
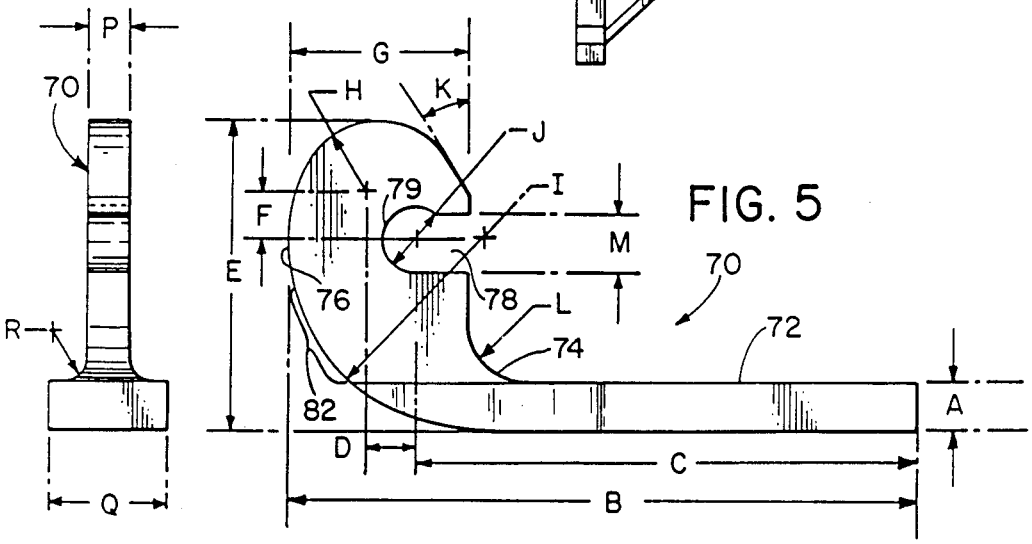
FIG. 5
FIG. 7
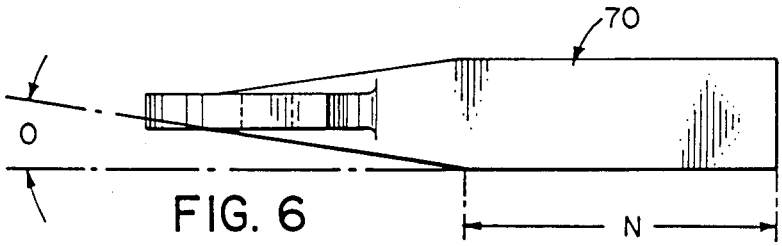
FIG. 6

RESTRICTING BRACKET FOR AUTOMATIC TRANSPORT SYSTEM

This is a continuation of co-pending application Ser. No. 738,089, now abandoned, filed on May 24, 1985 and titled Restricting Bracket for Automatic Transport System.

BACKGROUND OF THE INVENTION

The invention relates generally to automatic transport systems, and deals more particularly with an improved automatic transport system of the type having a guide portion which slopes downwardly and free traveling carriers which ride on the guide portion, the improvement comprising a device which limits the forward travel of the carriers on the downwardly sloping guide portion and on other non-sloping guide portions.

Automated transport systems of the type with which this invention is concerned may be used in a garment making plant to carry workpieces to a series of work stations where various work operations are performed or to storage sites. Such a transport system is disclosed in U.S. Pat. No. 4,615,273 filed 12-19-84 by Roald Paul Nymark and Harold Osthus, assigned to the assignee of the present invention and hereby incorporated by references as part of the present disclosure. The aforesaid system is highly automated and includes free traveling trolleys which carry workpieces and a rail network on which the trolleys ride, which network comprises a main rail and subsidiary rail loops. The main rail guides the trolleys to the subsidiary rail loops and the subsidiary rail loops guide the trolleys to and from the work stations or serve as storage sites. The rail network also includes an endless, moving chain adjacent the main rail and pushers attached thereto and spaced along the chain to engage the trolleys and propel them along the main rail and switches for transferring the trolleys to and from the subsidiary rail loops.

Each of the subsidiary loops has a gap adjacent the main rail and, likewise, the main rail has a gap adjacent each subsidiary loop, and the associated switch comprises a short section of rail and an actuator apparatus which is capable of moving the rail section from a first position bridging the gap in the main rail to a second position bridging the gap in the subsidiary loop and vice versa. To switch a trolley from the main rail to a subsidiary rail loop, the rail section is initially located in the gap of the main rail and receives a trolley propelled by a pusher. Then, the actuator apparatus moves the rail section, while the trolley is received on it, to the gap in the subsidiary loop and the pusher propels the trolley onto a rail of the subsidiary rail loop.

Another trolley and rail system comprises a main rail, subsidiary rail loops, and a switch adjacent each subsidiary loop, free traveling trolleys which ride on the rails, pushers for the trolley. Each switch comprises a pair of pivoting fingers having their pivot axis on the main rail. When both pivoting fingers are closed, a trolley is guided over the switch along the main rail and, when one pivoting finger is opened, a trolley is guided toward or received from the subsidiary loop.

In both types of trolley and rail systems described above, a computer is utilized to control the routing of the trolleys to the subsidiary loops and does so in part by controlling the switching mechanisms associated with them. To perform a proper switching operation, the movement of the switch must be timed with the arrival of the designated trolley, and the computer estimates the position of the trolley primarily from the location of its pusher. With either type of switch described above, and with other types of switches, there are discontinuities in either the main rail or the subsidiary loop at all times which discontinuities make it possible for a trolley to inadvertently fall off the rail network.

To compound the problem, it is sometimes advantageous to locate subsidiary loops used for storage several feet above the floor to conserve workspace so that the space beneath the storage loops can be used for work stations, other storage sites, walkways, or other purposes in which case at least one portion of the rail network slopes upwardly and at least one portion slopes downwardly. Also, such automated transport systems may occupy two floors of a factory in which case at least one portion of the rail network slopes upwardly and at least one portion slopes downwardly to link the two floors. If a free traveling, unrestricted trolley rides on such a downwardly sloping portion of a rail network, the trolley rolls ahead of its pusher and descends along the sloping rail portion to the rear of the next pusher, typically 3–5 feet downstream. If the downwardly sloping rail portion is located just upstream of a switch scheduled to divert the trolley, and the pusher does not catch up to the trolley before reaching the switch, the trolley may roll past the switching mechanism before the computer directs the switch to move to the subsidiary loop and hence avoid the switching operation. Also, it is possible in the patent pending system for the trolley immediately in front of the errant trolley to be scheduled to divert to the subsidiary loop and for the errant trolley to fall off the rail through the gap left when the switching mechanism attempts to switch the trolley in front, or for the errant trolley to be inadvertently switched later on to an unscheduled work station or storage site or to jam the system.

There are other factors besides the downward slope of a rail portion which cause a trolley to advance ahead of its pusher and potentially cause problems of the types described above. For example, an air draft from an open door or window may act upon garments suspended from the trolley as a wind acts on a sail, a person may inadvertently brush against a trolley or the associated workpieces, or an operator loading a trolley onto the rail may inadvertently push the trolley forward.

Accordingly, a general aim of the present invention is to improve a transport system of the type having free traveling carriers, a guide for the carriers, and pushers for the carriers so that the carriers cannot advance much ahead of their associated pushers when urged in that direction by gravity or other external force.

A more specific aim of the invention is to provide such an improvement which is simple in construction and use and does not appreciably interfere with the routing of carriers through the system.

Other aims and advantages of the invention will become apparent from the following detailed description and accompanying drawings.

SUMMARY OF THE INVENTION

The invention resides in a restricting means for a transport system of the type having a plurality of free traveling carriers, a guide for the carriers, and means for propelling the carriers along the guide. According to one feature of the invention, the propelling means includes an endless, moving chain and pushers which extend from the chain and drive the carriers, and the restricting means comprises a plurality of brackets which extend downwardly from the chain, one in front of each pusher defining a carrier pocket for containing a carrier. According to another feature of the invention, each of the brackets is pivotally mounted on the chain within limits defining a loading position to admit a carrier into the carrier pocket and a blocking position to prevent the carrier from escaping from the pocket.

According to another feature of the invention, each restricting bracket is releasably secured to the chain.

BRIEF DESCRIPTION OF THE DRAWINGS

FIG. 4 is a rear sectional view of a trolley, a propulsion track, a restricting bracket and a pusher of the automated transport system of FIG. 1.

FIG. 5 is a side view of a restricting bracket of the automated transport system of FIG. 1.

FIG. 6 is a top view of the bracket of FIG. 5.

FIG. 7 is an end view of the bracket of FIG. 5.

DETAILED DESCRIPTION OF THE PREFERRED EMBODIMENTS

Figure 1:
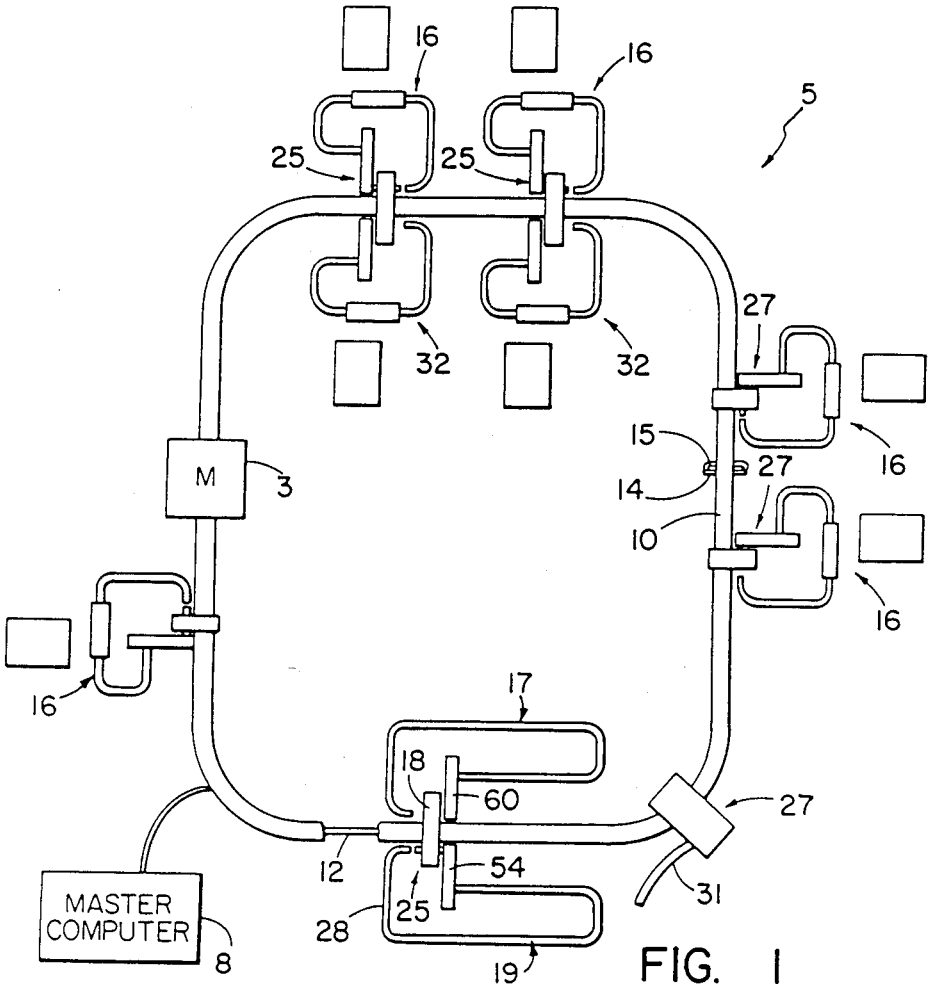
FIG. 1 is a top view of a automated transport system which utilizes the invention.

Turning now to the drawings, FIG. 1 illustrates an automated transport system generally designated 5 which utilizes the invention. The system includes a master computer 8, a propulsion track 10 having pushers 15,15 extending downwardly therefrom, a motorized drive unit 3 for the propulsion track 10, a main rail situated beneath the propulsion track 10, free traveling trolleys 14,14 riding on the rail 12 and propelled by the pushers 15,15, and subsidiary loops 16,16, 32,32, 17 and 19 located along the main rail some of which are paired. Each of the subsidiary loops 16,16 and 32,32 leads to and from a work station 33 or 35 and the subsidiary loops 17 and 19 are used for storage. The automated transport system further includes three position switches 25,25 for routing the trolleys between the main rail and each pair of subsidiary loops or directly between the subsidiary loops of a given pair, and three position switches 27,27 for routing the trolleys between the main rail and each unpaired subsidiary loop or a diversion rail 31. The system of FIG. 1 includes a total of nine subsidiary loops but can easily be modified to include more or fewer loops if desired.

Figure 2:
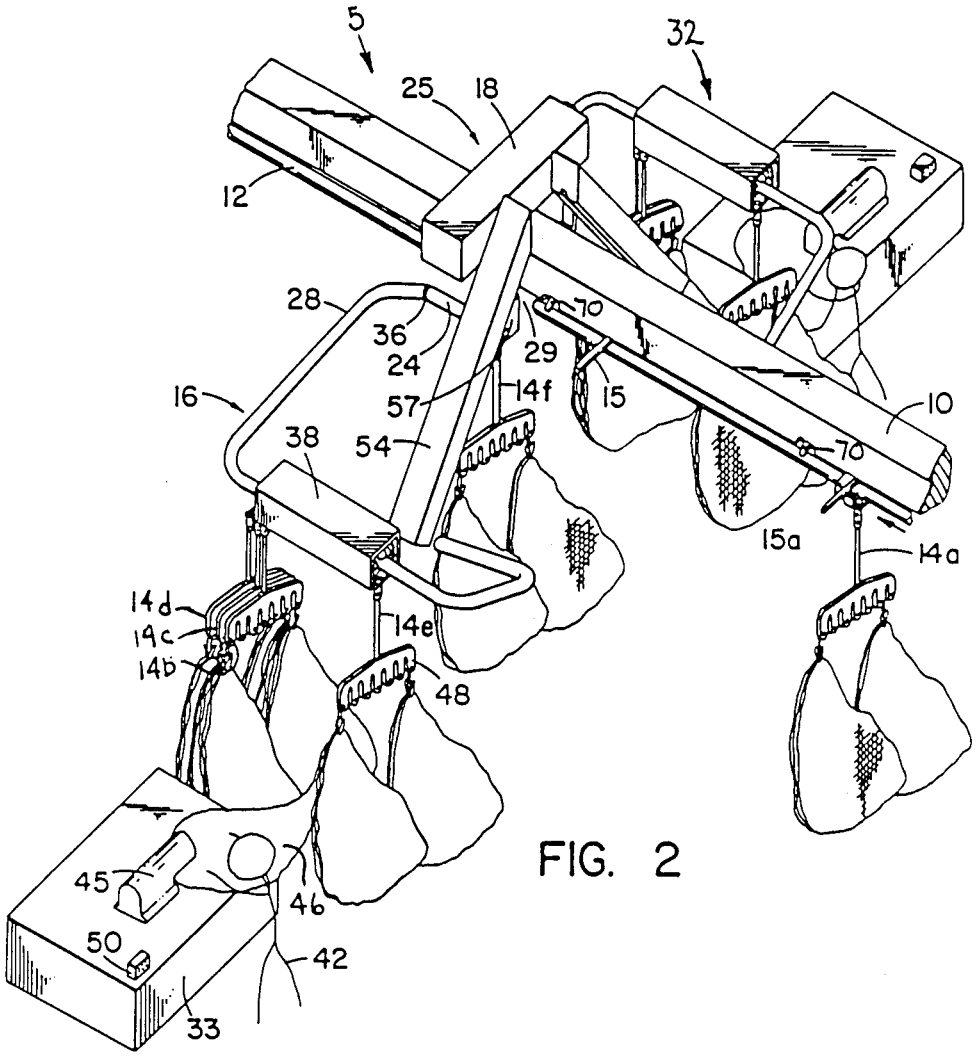
FIG. 2 is a perspective view of a section of the automated transport system of FIG. 1.

FIG. 2 illustrates a section of the automated transport system 5 of FIG. 1, and shows the main rail 12, the propulsion track 10 situated above the main rail and a pair of subsidiary loops 16 and 32. One of the trolleys 14, specifically identified as **14*a*, rides on the main rail 12 and is propelled by one of the pushers 15 specifically identified as 15*a*. Pusher 15*a* is one of a series of identical pushers uniformly spaced along and extended downwardly from the track 10. The pusher 15*a* itself is driven by an endless, moving chain (FIGS. 8 and 9) located within the overhead propulsion track 10, and in FIG. 1, the pusher is shown moving trolley 14*a* toward the subsidiary loop 16. A series of restricting brackets 70,70 also extend downwardly from the track 10, one in front of each of the pushers 15,15. The subsidiary loop 16 includes a looping rail 28, a stop 38, and an elevator 54, and the oppositely-disposed subsidiary loop 32 is a mirror image of the loop 16**.

The main rail 10, subsidiary loop 16, and subsidiary loop 32 each have a gap laterally aligned with one another, and the switch 25 includes a straight section of rail 24 and an actuator apparatus 18 controlled by the computer 8. The main rail 12, the rail section 24, and the looping rails 28 preferably are made of piping. Actuator apparatus 18 is responsible for moving the rail section 24 laterally between a first position (as shown) bridging the gap in subsidiary loop 16, a second position bridging the gap 29 in main rail 12, and a third position bridging a gap (not shown) in subsidiary loop 32.

To transfer a trolley from the main rail to the subsidiary loop 16, the rail section 24 is initially positioned in the gap of the main rail and one of the pushers 15 pushes a trolley from the main rail 12 onto the rail section 24. Then, the computer directs the actuator 18 to move the rail section 24 toward the gap in the subsidiary loop 28. While the trolley is on the rail section 24, the pusher 15 continues to engage the trolley because the pusher is wide and when the rail section reaches the gap in the subsidiary loop 16, the pusher pushes the trolley onto an entrance portion 36 of the looping rail 28. Then, the actuator 18 returns the rail section 24 to the main rail 12 so that other trolleys can proceed down the main rail or be switched by the rail station.

The looping pipe 28 of the subsidiary loop 16 slopes downwardly from its entrance 36 so that a trolley rolls along it by gravity. About midway along the looping rail 28 is the stop 38 which includes an upper gate and a lower gate (neither gate shown). The stop 38 is shown backing up trolleys **14*b–d* at its upper gate, trolley 14*b* being first in line. There the trolley 14*b* waits until an operator 42 is ready for it and presses a button on control box 50 to open the upstream gate of stop 38 and allow it to roll to the downstream gate located at the base of the stop 38 adjacent the operator as has done trolley 14*e*** previously.

In FIG. 2, the operator 42 is shown sewing a workpiece 46 carried by the trolley **14*e* sewing with machine 45, and when done with all the workpieces suspended from the trolley, he or she may push a button on control box 50 to cause the downstream gate of stop 38 to open and allow trolley 14*e* to roll by gravity toward the elevator 54**.

At the base of elevator 54 is another stop (not shown) to collect trolleys while they wait their turn to be reloaded onto the main rail 12. When the master computer senses an absence of trolleys on the rail section 24 and on a portion of the main rail 12 just upstream of the rail section 24, the computer directs actuator 18 to move rail section 24 to subsidiary loop 16 and activates the elevator stop and elevator 54 to admit a trolley into an elevator car, which car comprises a slotted track section 57 for receiving the trolley. Then, the computer directs the elevator to elevate the trolley as it has done to the trolley 14 indicated as f shown in FIG. 1, and after the trolley reaches the top of the elevator 54, the next arriving pusher pushes the trolley from the slotted track section 57 onto the rail section 24.

In one mode of operation, after the rail section 24 receives the trolley, the computer directs actuator 18 to draw the rail section 24 back into line with main rail 12 and after a few more moments of being pushed, the trolley returns to the main rail 12 and proceeds downstream, usually to another subsidiary loop and an associated work station.

Figure 3:
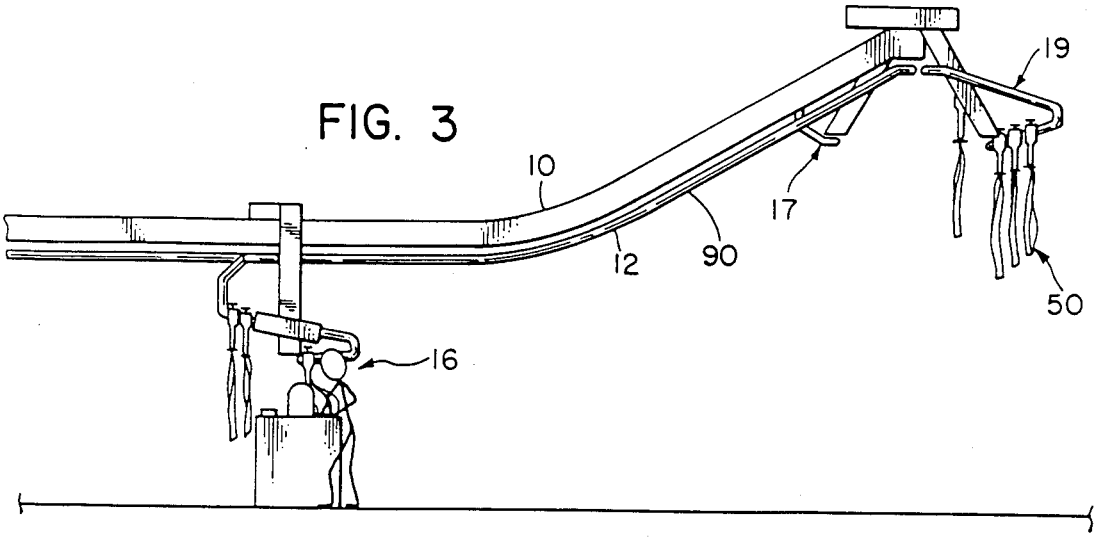
FIG. 3 is a side view of another section of the automated transport system of FIG. 1.

FIG. 3 illustrates that the subsidiary loops 17 and 19 are substantially elevated relative to the subsidiary loop 16 and the associated work station, for example, eight feet higher than the subsidiary loop 16. This is done to conserve work space; the storage loops and the stored trolleys and work pieces 50 are elevated enough to allow people to walk or work underneath, to allow other workpieces or equipment to be positioned underneath, or to allow other functions to be performed underneath. A downwardly sloping portion 90 of the rail 12 leads from the subsidiary loop 19 to the subsidiary loop 16.

FIG. 4 shows a rear view of the trolley 14 indicated as n, a pusher 15 indicated as c which engages it, and the restricting bracket 70. The trolley **14*n* has two wheels 144 and 146 which ride on one of the rails of the system 5. The wheels attach to the inside of an upper hook-shaped portion 141 of the trolley and straddle the rail upon which they ride to provide balance. At the top of trolley 14*n* is a T-shaped crown portion 66 which is the portion of the trolley actually engaged by the pusher 15*c*. The pusher 15*c* has an inverted T-shape and extends downwardly from the inside of the propulsion track 10 behind the trolley 14*n* (relative to the direction of trolley movement on the main rail), and within the track, an endless, moving chain 150 attaches to the pusher 15*c* and drives it. Similarly, the restricting bracket is attached to and driven by the chain 150, which bracket is situated in front of the trolley 14*n***.

Focusing now on the invention, FIGS. 5, 6 and 7 illustrate the restricting bracket 70 which is formed from metal or plastic and comprises a stem portion 72, a neck portion 74, a throat portion 79, and a curved head portion 76 having a back portion 82 and a pivot recess 78. By way of example, the bracket 70 is made of cast aluminum and has the following dimensions:

A=0.25 (all dimensions in inches unless otherwise indicated)
B=3.25
C=2.594
D=0.2
E=1.625
F=0.220
G=0.913
H=0.310 (Diameter)
I=1.0
J=0.332 (Diameter)
K=30 Degrees
L=0.563 (Radius)
M=0.312
N=1.625
O=9 Degrees
P=0.188
Q=0.563
R=0.125 (Radius)

Also, the vertical distance between the chain 150 and the rails 12 and 24 is such that when the bracket is suspended from the chain, it reaches just below the crown portion 86 of a trolley 14 which it restricts.

Figure 8:
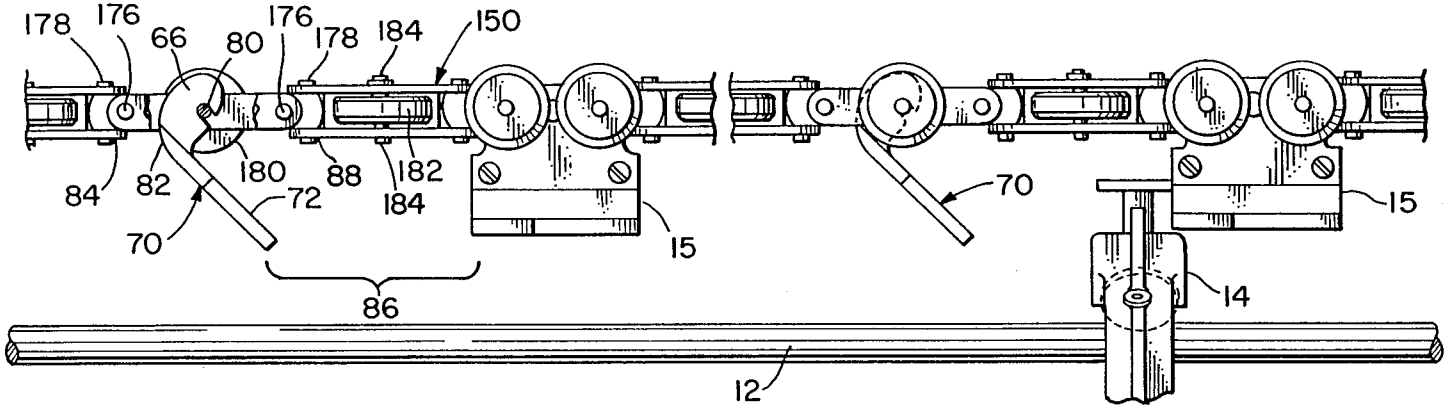
FIG. 8 is a side view of a section of a chain within a propulsion track of the automated transport system of FIG. 1 and shows the restricting bracket of FIG. 5.
Figure 9:
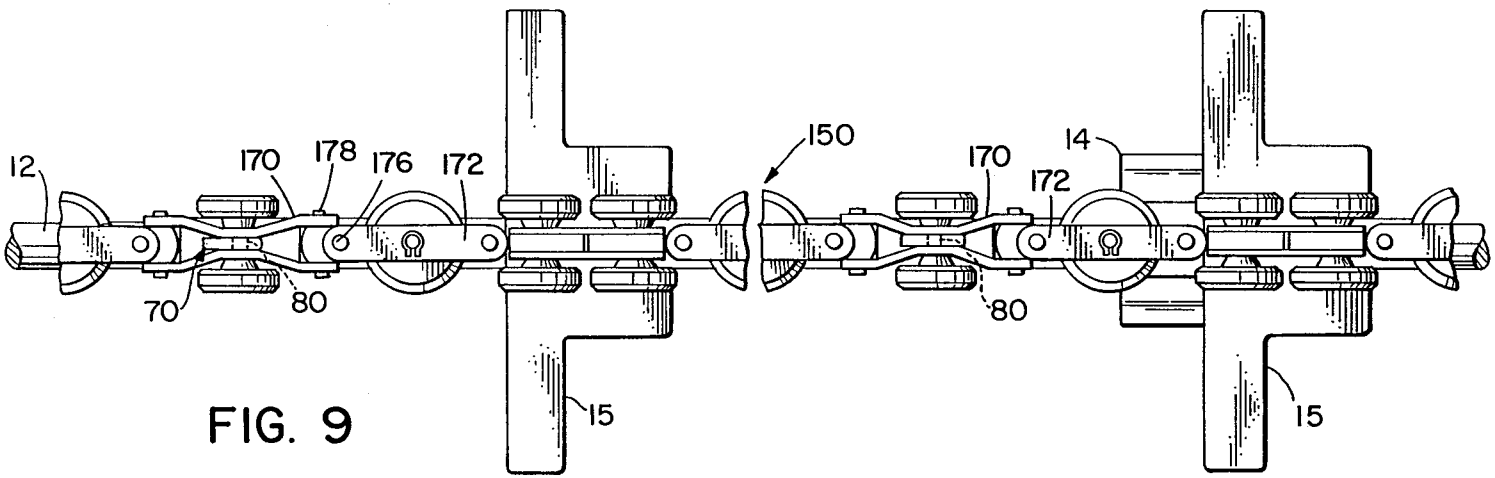
FIG. 9 is a top view of FIG. 8.

FIGS. 8 and 9 show the chain 150 of the propulsion track 10 and the restricting brackets 70,70. The chain includes links 170,170 and 172,172, the link 170 being connected to the link 172 via a horizontal pin 176 and a vertical pin 178 to allow relative vertical and horizontal pivoting as required to follow the course of the main track 10. The chain 150 further includes vertical wheels 180,180 mounted on pin 80,80 and horizontal wheels 182,182 mounted on pin 184,184 which wheels guide the chain within the main track 10. The bracket 70 releasably attaches by a snap fit to the horizontal axle 80 of the chain with the pivot recess 78 engulfing the axle at the throat 79 and the bracket 70 pivoting on the axle. Because of the design and dimensions of the bracket 70 described above, the bracket 70 balances itself in the orientation shown in FIG. 8 with the bracket stem portion 72 angled at approximately 45 degrees relative to a horizontal plane.

In the illustrated embodiment, one of the brackets 70,70 is installed in front of each associated pusher, and by way of example, the separation distance is approximately eight inches. This space defines a trolley pocket 86 and allows plenty of room to house one trolley, yet is short enough to allow the computer to keep reasonably apprised of the trolley's whereabouts.

The bracket 70 may pivot rearwardly (counterclockwise) to a trolley loading position where the stem portion 72 is oriented approximately horizontal and abuts the link 88 of the chain 50, and may pivot forwardly (clockwise) to a trolley blocking position where the stem portion is oriented approximately vertical and the back portion 82 of the head portion 66 abuts a spacer 84. To load a trolley into the trolley pocket 86, the trolley may be inserted directly over a portion of the rail within the pocket or inserted on a portion of the rail in front of the associated restricting bracket 70 and either held in place until the bracket 70 overtakes the trolley and pivots upwardly to the trolley loading position to admit it into the pocket, or slid rearwardly until it contacts the bracket, forces it to pivot upwardly, and enters the pocket. Alternately, the trolley may be left on the rail to await the arrival of the next bracket 70 in which case, when the bracket 70 reaches the trolley, the bracket pivots upwardly to admit it, the inertia of the trolley being large enough to cause the bracket to admit it instead of pushing it ahead. The 45 degree balancing orientation of the bracket facilitates the admission of a trolley into the trolley pocket from a position initially forward of the bracket as described above.

Figure 10:
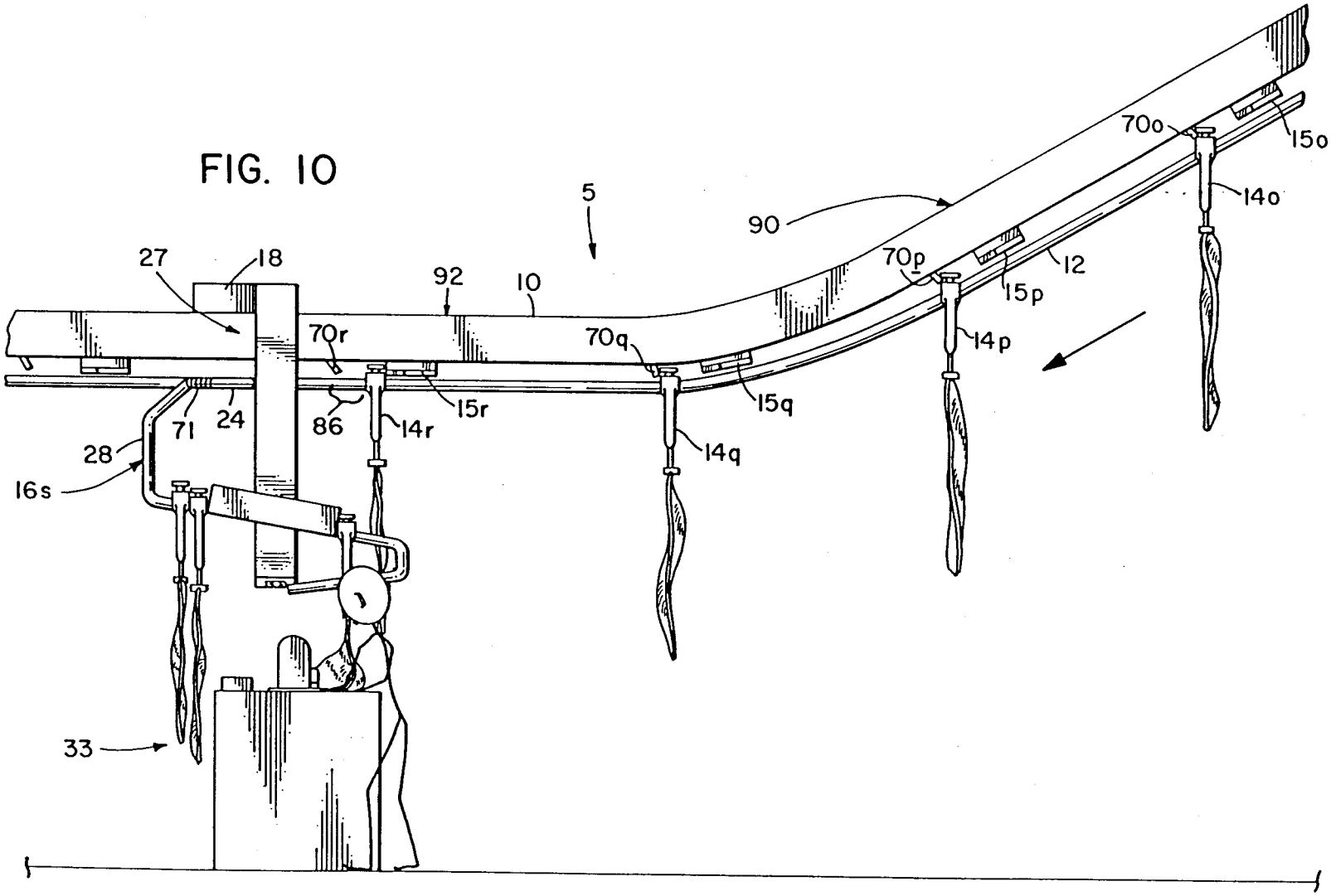
FIG. 10 is a side view of a downwardly sloping portion of a rail network of the automated transport system of FIG. 1.

FIG. 10 shows the downwardly sloping portion 90 of the rail 12 leading to the subsidiary loop 16 indicated as s and illustrates one role of the restricting brackets 70,70. The trolley 14 indicated as o rides on the sloping rail portion 90 and has rolled ahead of the associated pusher 15 indicated as o by gravity to the bracket 70 indicated as of which bracket has pivoted slightly forward due to the slope of the rail portion 90 and the weight of the trolley **14-*o* to its trolley blocking position. If not for the bracket 70-*o* it would roll all the way to the rear of the pusher 15 indicated as p. The trolley 14 indicated as q is shown riding on the beginning of a horizontal portion 92 of the rail 12 but previously rode on the sloping portion 90. At which previous time, the trolley 14-*q* forwardly advanced to the rear of the restricting bracket 70 indicated as q and when the trolley 14-*q* reached the beginning of the horizontal portion 92, as shown, i.ts momentum maintained it somewhat ahead of the pusher 15 indicated as q. Afterwards, the trolley 14-*q* will gradually recede from the bracket 70-*q* as its momentum dissipates until it is re-engaged by the pusher 15**-*q*, just as the pusher 15 indicated as r has caught up and re-engaged the trolley 14 indicated as r.

To conserve work space, the subsidiary loop 16 indicated as s and the associated work station 33 are located near the base of the sloping rail 90.

Assuming that the trolley 14-*r* is programmed to enter the loop 16-*s*, shortly after the pusher 15-*r* passes over the upstream end of the rail section 24 of the switch 27, the computer directs the actuator apparatus 18 to transfer the rail section 24 to the gap in the subsidiary loop 16-*s*. The distance from the pusher 15-*r* to the bracket 70 indicated as r plus the distance that the pusher advances while the trolley is laterally transferred is less than the length of the rail section 24, so the trolley will remain on the rail section 24 during switching and not forwardly advance beyond the rail section regardless of where the trolley is located within the trolley pocket 86.

Note that if the restricting bracket 70-*r* was not installed, the trolley 14-*r* may have rolled much further ahead of the pusher 15-*r* and onto the rail section 24 much before the arrival of the pusher 15-*r*, and unless stopped by corrugations 71 on the rail section, bypass the switching operation altogether. Also without the bracket 70-*q*, the trolley 14-*q* may have rolled all the way to the rear of the pusher 15-*r* and when the rail section 24 moves laterally to attempt to switch the trolley 14-*r*, the trolley 14-*q* may fall off the main rail through the gap left by the rail section 24 or jam or be switched by the switch 27.

After the trolley 14-*r* circulates around the looping rail 28 of the subsidiary loop 16-*s*, it is carried upwardly by the elevator 54, met by the rail section 24, and pushed by the next pusher onto the rail section 24 to be carried toward the main rail. Since the bracket 70 associated with the pusher is forward of the pusher, when the rail section 24 arrives in line with the main rail, the trolley is received within the respective trolley pocket 86 and can proceed downstream, or be laterally transferred to the subsidiary loop 18 as directed by the computer.

It is possible, although unlikely, that when a trolley is first engaged by the pusher 15 at the top of the elevator, it is bumped forward of the pusher along the rail section 24 or rolls forward by gravity on the rail section 24 due to an inadvertent slope. The corrugations 21 on the rail section 24 stop the trolley before it falls off the rail section. If the trolley 14 rolls eight inches ahead of the pusher when the rail section 24 arrives in line with the main rail, the trolley will strike the bracket 70 broadside. However, due to the slope of the stem 72 of the bracket 70, the bracket will usually pivot upwardly and eventually admit the trolley. It is also possible for the trolley to pause when it strikes the bracket, tipping slightly on the rail section 24, until the bracket 70 advances forward of it due to the forward movement of the chain 150 and then enter the trolley pocket. If the trolley rolls further than 8 inches ahead of the pusher it will be located ahead of the restricting bracket, but will soon be automatically engulfed by it, the corrugations 71 ensuring that the bracket 70 overtakes it.

By the foregoing, a restricting bracket for a automated transport system has been disclosed embodying the present invention. However, numerous modifications and substitutions may be made without deviating from the scope of the invention. For example, if desired, the bracket 70 may be manufactured integral with the chain so that it is not readily attachable or detachable from it. Also, if desired, the tip of the stem 72 of the bracket 70 may be widened as an inverted T-shape in the event that the bracket 70 is utilized with a trolley which has a vertically narrow top instead of the wide, T-shaped crown 66. It is also possible to put bevels in the side edges of the stem 72 of the bracket 70 so that in the event a trolley strikes the stem 72 broadside, the bevels will facilitate the upward pivoting of the bracket 70 to admit the trolley into the pocket 86. Also, the restricting bracket 70,70 can be used in a rail network having sloped portions which interconnect two floors. Therefore, the invention has been disclosed by way of illustration and not by limitation.

I claim:

1. In an automated transport system, the combination comprising:

a rail, a plurality of free traveling workpiece carries which ride on said rail, a chain for propelling said workpiece carriers along said rail, said chain including a plurality of pushers for engaging said workpiece carriers and a horizontal pin extending transversely of said chain spaced ahead of each of said pushers, a restricting bracket pivotally suspended from each of said pins for permitting the associated one of said pushers to move into engagement with a workpiece carrier initially located downstream of said restricting bracket and for thereafter preventing said workpiece carrier from moving forwardly of said associated pusher beyond said restricting bracket, said restricting bracket having a curved head portion and an elongated stem portion extending downwardly from said head portion into the path of said workpiece carrier, said head portion including an inwardly extending recess for receiving said pin and terminating in a throat having a generally downwardly facing bearing surface pivotally engaged with said pin, said head portion being manually moveable along said recess in upward relation to said pin to remove said restricting bracket from said pin and chain, and means for limiting the pivotal movement of said restricting bracket relative to said chain in the direction corresponding to forward pivotal movement of said stem portion, said means for limiting the pivotal movement of said restricting bracket relative to said chain being a spacer on said chain forward of said pin for engaging said stem at a point located along the length of said stem between said pin and the point at which said carrier engages said stem so that the force exerted by said carrier on said stem tends to pivot said stem about said spacer to urge said bearing surface of said throat into engagement with said pin and to thereby oppose movement of said bracket from said pin.

2. The combination as set forth in claim 1 wherein each of said restricting brackets is made of plastic, and said recess of each of said restricting brackets at one point along its length has a width less than the diameter of said pin receiving said bracket so that said bracket has a snap action as it is moved on to and off of said pin.

* * * * *